US008743160B2

(12) United States Patent
Xu

(10) Patent No.: US 8,743,160 B2
(45) Date of Patent: Jun. 3, 2014

(54) ACTIVE MATRIX ORGANIC LIGHT-EMITTING DIODE DISPLAY AND METHOD FOR DRIVING THE SAME

(76) Inventor: Chihao Xu, Saarbruecken (DE)

( * ) Notice: Subject to any disclaimer, the term of this patent is extended or adjusted under 35 U.S.C. 154(b) by 28 days.

(21) Appl. No.: 13/309,136

(22) Filed: Dec. 1, 2011

(65) Prior Publication Data

US 2013/0141469 A1 Jun. 6, 2013

(51) Int. Cl.
*G09G 5/10* (2006.01)
*G09G 3/30* (2006.01)

(52) U.S. Cl.
USPC ..... 345/690; 345/77

(58) Field of Classification Search
USPC ..... 345/76–77, 84, 86–87, 98, 100, 205, 345/207, 211–212, 214, 690; 315/169.3; 348/687
See application file for complete search history.

(56) References Cited

U.S. PATENT DOCUMENTS

| | | | | |
|---|---|---|---|---|
| 5,990,629 | A | 11/1999 | Yamada et al. | |
| 6,157,356 | A * | 12/2000 | Troutman | 345/82 |
| 8,269,803 | B2 * | 9/2012 | Yoo et al. | 345/690 |
| 2003/0076048 | A1 * | 4/2003 | Rutherford | 315/169.3 |
| 2005/0052365 | A1 * | 3/2005 | Jang | 345/76 |
| 2005/0212729 | A1 * | 9/2005 | Chung et al. | 345/76 |
| 2007/0279343 | A1 * | 12/2007 | Kim | 345/77 |
| 2009/0195483 | A1 * | 8/2009 | Naugler et al. | 345/76 |
| 2009/0195484 | A1 * | 8/2009 | Lee et al. | 345/76 |
| 2011/0109670 | A1 * | 5/2011 | Sempel et al. | 345/692 |
| 2011/0122164 | A1 * | 5/2011 | Kimura et al. | 345/690 |
| 2011/0181786 | A1 * | 7/2011 | Yamazaki et al. | 348/671 |
| 2011/0205259 | A1 * | 8/2011 | Hagood, IV | 345/690 |
| 2011/0254871 | A1 * | 10/2011 | Yoo et al. | 345/690 |
| 2011/0267378 | A1 * | 11/2011 | Itokawa et al. | 345/690 |
| 2012/0056916 | A1 * | 3/2012 | Ryu et al. | 345/691 |
| 2012/0139955 | A1 * | 6/2012 | Jaffari et al. | 345/690 |
| 2012/0249514 | A1 * | 10/2012 | Ahn | 345/212 |

OTHER PUBLICATIONS

Written Opinion and International Search Report dated Jul. 10, 2013, as issued in corresponding International Application No. PCT/IB2012/002907, filed Dec. 3, 2012, 15 pages.

* cited by examiner

*Primary Examiner* — William Boddie
*Assistant Examiner* — Amy C Onyekaba
(74) *Attorney, Agent, or Firm* — Maier & Maier, PLLC

(57) ABSTRACT

In one exemplary embodiment, a method for driving an AMOLED display having OLED arranged in rows and columns, a pixel circuit for driving an OLED, a scan line for selecting the pixel circuits of each row and a data line for controlling the pixel circuits of each column and supply lines connectable to the anodes and cathodes of the AMOLED pixels may be described. The method may be steps for decomposing image data into a plurality of subframes based on a dependence of physical characteristics of the AMOLED display; generating binary subframe signals according to the decomposed subframes; activating an OLED, based on a scan signal on the scan line and a generated subframe signal applied on the data line, allowing or blocking a current to flow through the organic light emitting diode; and connecting the supply lines to a voltage source for a predetermined duration for each subframe.

33 Claims, 11 Drawing Sheets

1002

1004

1006

ACTIVE MATRIX ORGANIC LIGHT-EMITTING DIODE DISPLAY AND METHOD FOR DRIVING THE SAME

BACKGROUND

In the prior art, there exists a multitude of active matrix circuits for OLED-displays having at least two transistors for each organic light emitting diode, wherein the transistors may be of the same or of a different type (NMOS and PMOS).

Prior art FIG. 1(*a*) shows a common active matrix circuit for an organic light emitting diode according to the state of the art. Every pixel circuit can have two NMOS transistors T1 (102) and T2 (103), the gate of transistor T1 being connected to the scan-line (105) and the drain of transistor T1 being connected to the data-line (106). The source of T1 is connected to the gate of transistor T2. The capacitor C1 (104) is connected between the gate and the source of T2. Such an active matrix circuit plus the organic light emitting diode (101) is called as AMOLED pixel in this invention. The AMOLED display in FIG. 1(*a*) (111) can have three rows and three columns and in total of 9 AMOLED pixels.

When the scan-line is activated (High), transistor T1 is switched on. Then, the driving transistor T2 receives the signal from the data-line and an electric current may flow from the voltage source Vs (108) via the column traces through the organic light-emitting diode to the ground, as indicated by the bold line in FIG. 1(*a*). In this description the traces from the positive pole of the power supply (voltage source) to the AMOLED pixels (anode) are called as column line (109). The power lines at the opposite side, not explicitly drawn in FIG. 1(*a*), namely the traces from the negative pole (ground) of the power supply to the AMOLED pixels (cathode) are called ground line (110). The data signal is an analog signal, i.e. not a high or a low signal but somewhere in between. The level of the signal depends on the desired luminance of the organic light-emitting diode. A higher luminance requires a higher diode current. When the desired gate voltage of transistor T2 has been applied, the scan signal of the selected row may be deactivated in order to select another row of the display. The capacity C1 is needed to preserve the gate voltage of transistor T2, permitting the electric current to flow constantly through the diode in the desired strength.

As transistor T2 in this circuit is always operated in the saturation region as an electric current source, a very precise and stable threshold voltage is required. But if the active matrix circuit is to be manufactured using a low cost process, transistors may exhibit large variations in their threshold voltage, that may also drift with time. Moreover, the circuit may only be operated at a high power loss, because a substantial voltage drop at the driving transistor T2 is needed for the current source mode. So the power supplied by the voltage source Vs (FIG. 1(*a*)) has to be considerably higher than the forward voltage of an OLED diode. With this drive scheme, pixels are illuminated substantially continuously.

This drive scheme, however, is disadvantageous because it is not power efficient and requires a complex and expensive manufacturing process for the active matrix. Also complex pixel circuits e.g. with more than two transistors are needed to compensate the variation and drift of the threshold voltage of the driving transistor. A large active-matrix OLED-display is therefore much more expensive than an active-matrix LCD-display. Consequently, large active-matrix OLED-displays may still not compete with corresponding LCD-displays.

BRIEF SUMMARY

In one exemplary embodiment, a method for driving an active matrix organic light-emitting diode (AMOLED) display having organic light-emitting diodes (OLED) arranged in rows and columns, a pixel circuit for driving an OLED, a scan line for selecting the pixel circuits of each row and a data line for controlling the pixel circuits of each column and supply lines connectable to the anodes and cathodes of the AMOLED pixels may be described. The method may be steps for decomposing image data into a plurality of subframes based on a dependence of physical characteristics of the AMOLED display; generating binary subframe signals according to the decomposed subframes; activating an organic light emitting diode, based on a scan signal on the scan line and a generated subframe signal applied on the data line, allowing or blocking a current to flow via the supply lines through the organic light emitting diode; and connecting the supply lines to a voltage source for a predetermined duration for each subframe.

In another exemplary embodiment, a method for the determination of a sequence of binary-value subframes used for addressing and driving an AMOLED display from a gray-value or a color value image may be described. This method can have steps for obtaining a binary value subframe from a remaining image by comparing the gray or color values with a predetermined threshold value; simulating, a pixel-wise luminance distribution of the AMOLED display, based on the binary subframe and the predetermined time factor; subtracting the pixel-wise luminance distribution of the AMOLED display from the actual remaining image data in order to calculate a next remaining image data; and iterating the above steps with a next remaining image instead of the remaining image.

In yet another exemplary embodiment, another method for simulating a pixel current distribution of an AMOLED display, wherein the display comprises a matrix of AMOLED pixels, arranged in rows and columns, wherein all AMOLED pixels are driven digitally; wherein all AMOLED pixels in a column are connected to a supply line for that column, wherein at least one end of the supply line is connected/switched to the voltage source, may be described. This method can have steps for estimating a value for a voltage/current for a selected node of the column; calculating at least one of a voltage value and a current value for remaining nodes of the column, based on one of an estimated voltage or current value; and iterating these steps in order to reduce a difference between a calculated voltage or current value and a real voltage or current value at a chosen location of the column.

In still another exemplary embodiment, a device for driving an active matrix organic light-emitting diode (AMOLED) display, the display comprising organic light-emitting diodes (OLED) arranged in rows and columns, a pixel circuit for driving an OLED, a scan line for selecting the pixel circuits of each row and a data line for controlling the pixel circuits of each column and supply lines connectable to the anodes and cathodes of the AMOLED pixels, may be described. The device can include a circuit that decomposes the image data into a plurality of subframes in dependence of the physical characteristics of the AMOLED display; a circuit that generates binary subframe signals according to the decomposed subframes; a circuit that activates an organic light emitting diode, based on a scan signal on the scan line and a generated subframe signal applied on the data line, and that allows or blocks a current from flowing through the organic light emitting diode; and circuit that connects the supply lines to a voltage source for a predetermined duration for each subframe.

In another exemplary embodiment, a device for the determination of a sequence of binary-value subframes used for addressing/driving an AMOLED display from one of a gray-value or a color value image may be described. This device can have a circuit that obtains a binary value subframe from one of a gray value or color value remaining image by comparing the gray or color values with a predetermined threshold value; a circuit that simulates a pixel-wise luminance distribution of the AMOLED display, based on the binary value subframe and a predetermined time factor; and a circuit that subtracts the pixel-wise luminance distribution of the AMOLED display from the source image data in order to calculate the next remaining image data.

In a different exemplary embodiment, a device for simulating a pixel current distribution of an AMOLED display, wherein the display comprises a matrix of AMOLED pixels, arranged in rows and columns, wherein all AMOLED pixels are driven digitally, wherein all AMOLED pixels in a column are connected to a supply line for that column, wherein at least one end of the supply line is connected/switched to the voltage source may be described. This device can include, for a column of AMOLED pixels in the matrix, a circuit that estimates a value for a voltage/current (Va1/Icn) for a selected node of the column; a circuit that calculates the voltage/current values for the remaining nodes of the column, based on the estimated voltage/current value; and a circuit that repeats the previous steps in order to reduce the difference between the calculated and the real voltage/current value at a chosen location of the column.

In still another exemplary embodiment, an active matrix organic light-emitting diode (AMOLED) display module may be described. The display module can have an active matrix organic light-emitting diodes (OLED) display, a device that determines a sequence of binary-value subframes used for addressing/driving an AMOLED display from one of a gray-value or a color value image, through simulation of a pixel current distribution of a digitally driven AMOLED display, and a device that connects the supply lines of an AMOLED display to a voltage source for a predetermined duration for each subframe, wherein at least one supply side of the AMOLED display, anode and/or cathode, is structured in parallel lines with one line for each column/row.

BRIEF DESCRIPTION OF THE FIGURES

Advantages of embodiments of the present invention will be apparent from the following detailed description of the exemplary embodiments thereof, which description should be considered in conjunction with the accompanying drawings in which like numerals indicate like elements, in which.

DETAILED DESCRIPTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage, or mode of operation.

Further, many of the embodiments described herein are described in terms of sequences of actions to be performed by, for example, elements of a computing device. It should be recognized by those skilled in the art that the various sequence of actions described herein can be performed by specific circuits (e.g., application specific integrated circuits (ASICs)) and/or by program instructions executed by at least one processor. Additionally, the sequence of actions described herein can be embodied entirely within any form of computer-readable storage medium such that execution of the sequence of actions enables the processor to perform the functionality described herein. Thus, the various aspects of the present invention may be embodied in a number of different forms, all of which have been contemplated to be within the scope of the claimed subject matter. In addition, for each of the embodiments described herein, the corresponding form of any such embodiments may be described herein as, for example, "a computer configured to" perform the described action.

It will now be explained in more detail, how an active-matrix display with organic light-emitting diodes may be operated according to the invention.

In this respect, the term brightness can designate the overall brightness of a display panel (for example about 500 cd/m$^2$) which may be set by the upper system or the user while the term luminance can be used for the brightness of individual pixels in a given image.

Figure 1A:
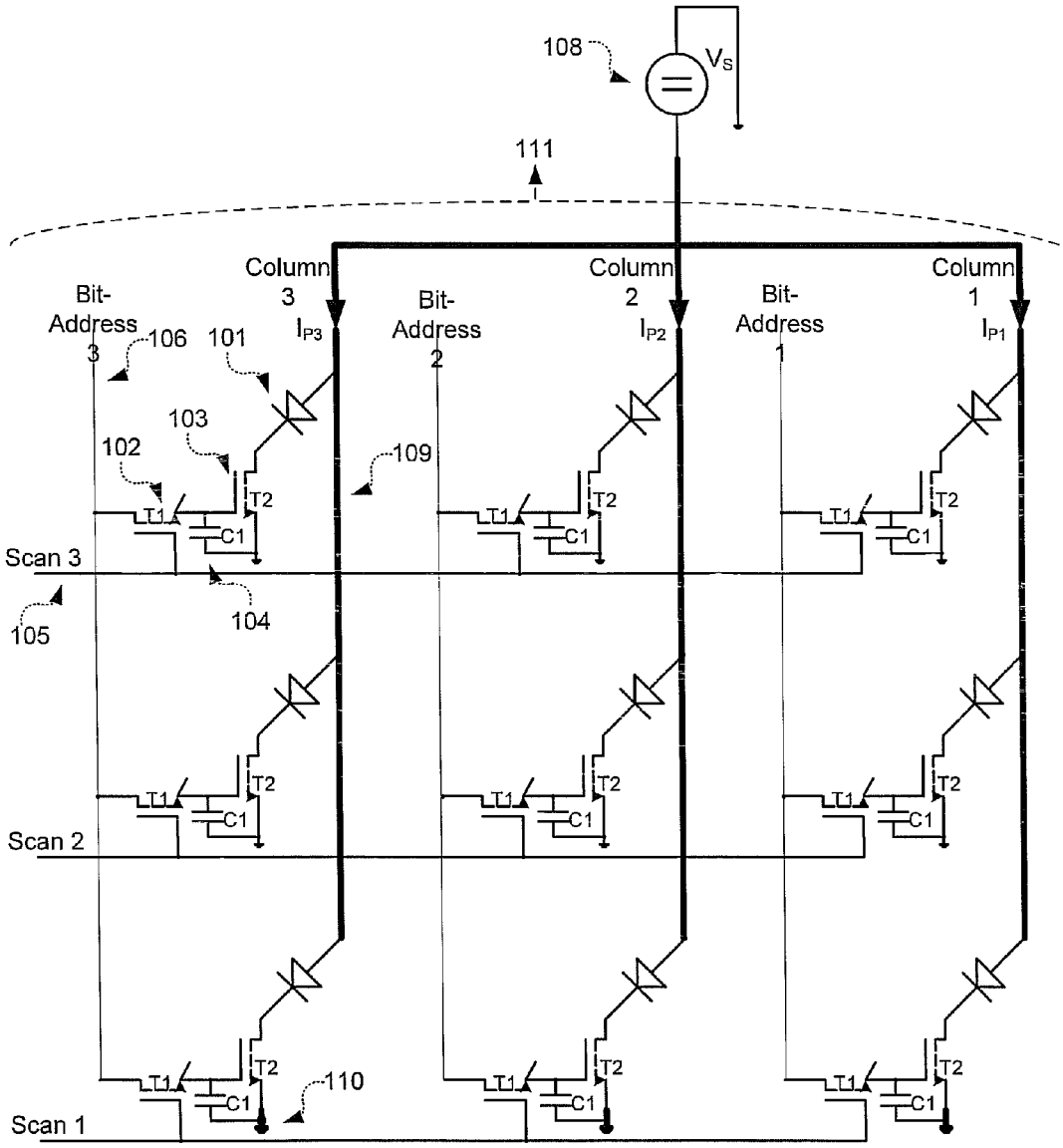
Fig. 1a (Prior Art)
FIGS. 1(*a*) and 1(*b*) show exemplary detailed circuits of active-matrix organic light emitting diode displays.
Figure 1B:
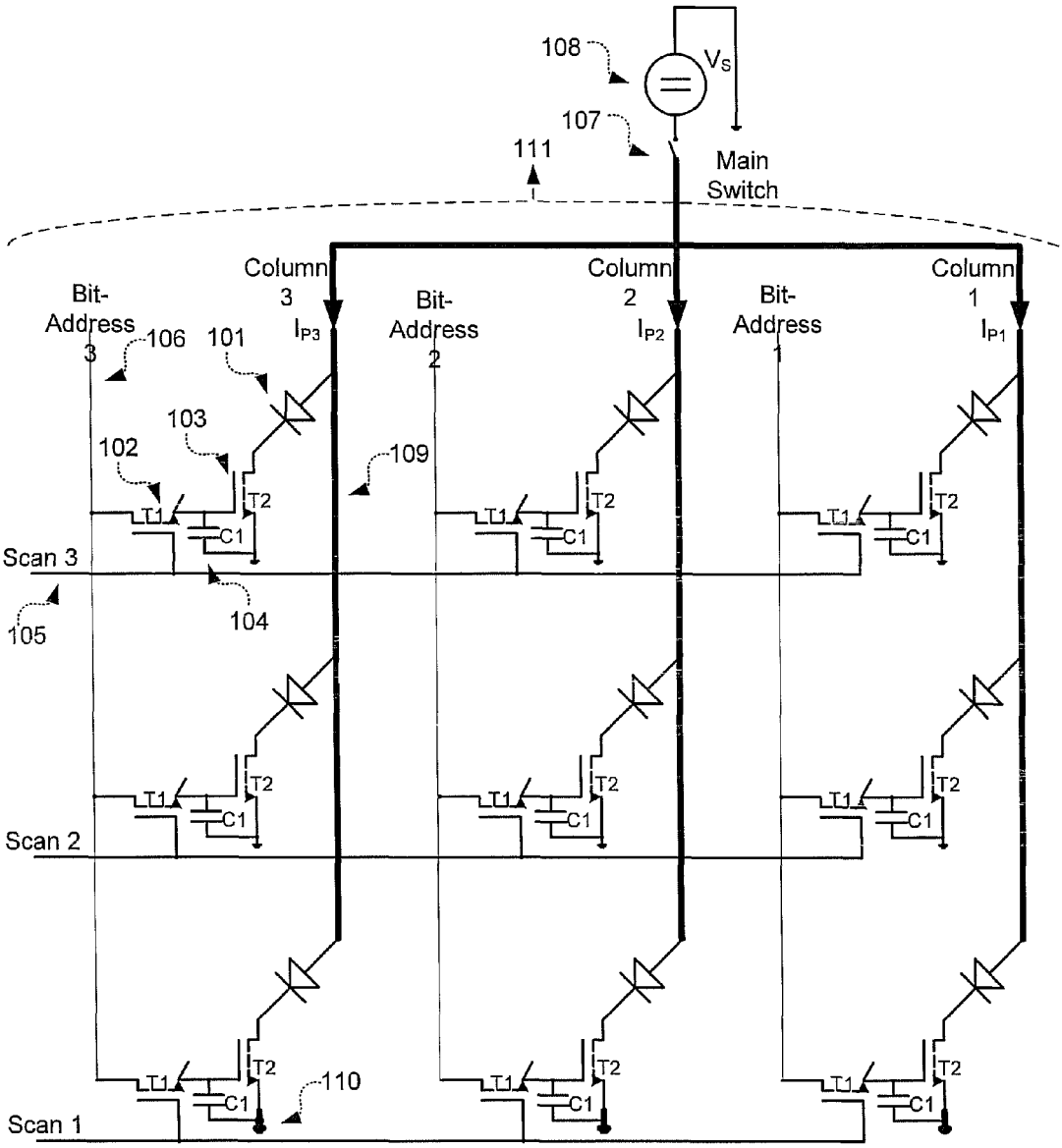
Figure 2:
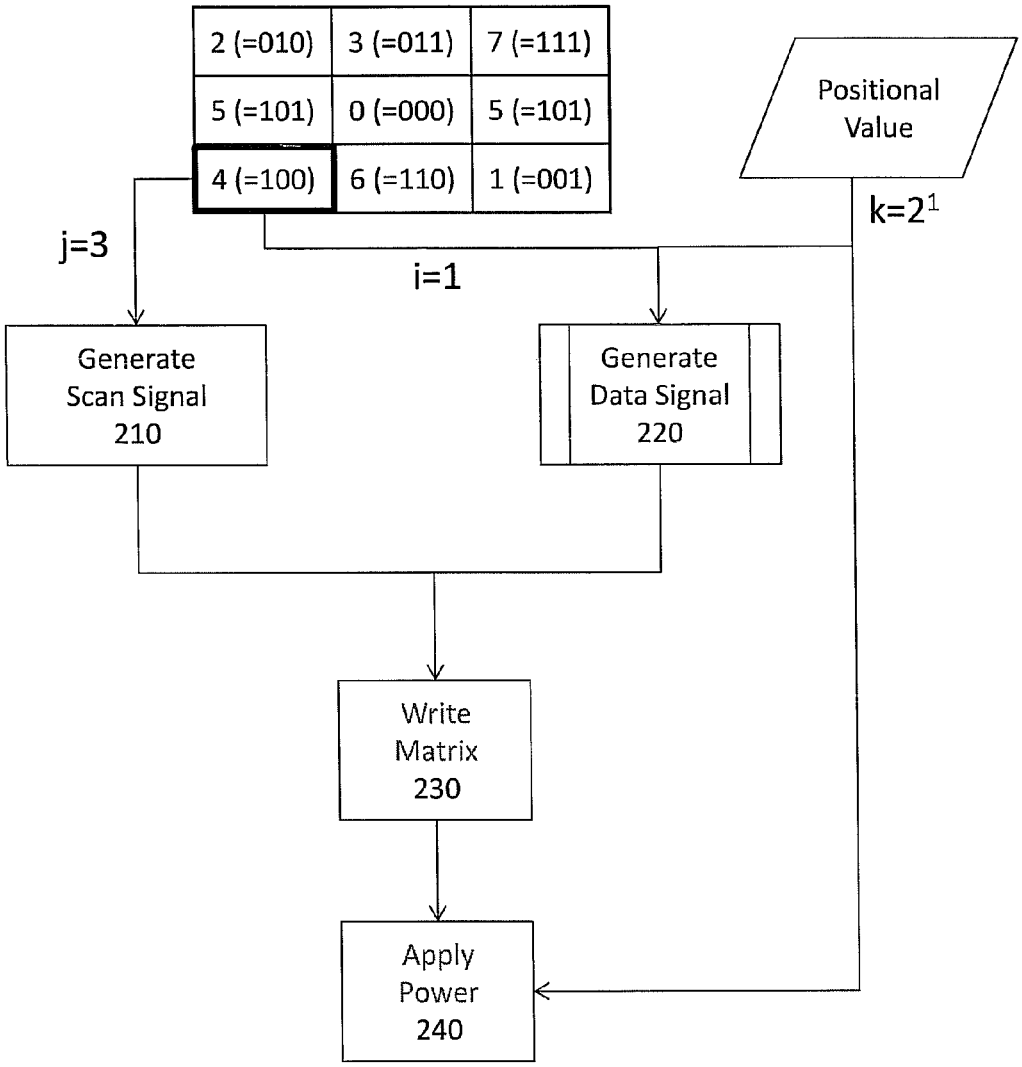
FIG. 2 shows an exemplary flowchart of an embodiment of a method according to the invention for driving the common active matrix organic light-emitting diode display shown in FIG. 1(*b*).

Exemplary FIG. 2 shows a diagram of an embodiment of a method for driving a common AMOLED-circuit such as that shown in exemplary FIG. 1(*b*). In this exemplary embodiment, for introduction and the sake of simplified understanding, the ideal case, if the resistance of the column lines and the ground lines are zero, is first described.

In step 210 of exemplary FIG. 2, a scan signal can be generated to a selected row. In the drive scheme according to the invention, the scan signal may be used to address a row of light-emitting diodes. More particularly, if the scan signal is applied to the gates of all transistors T1 of a row, as shown in FIG. 1(*b*), all transistors T1 of this row may now be turned on and the electric signals on the data lines can be applied to the gates of the transistors T2 and the capacities C1 of this addressed row. The gate potentials of T2s at other rows may not be altered, because the transistors T1 of these non-addressed rows are in an off state.

The scan signal may be a binary signal having a 'HIGH' state and a 'LOW' state.

In step 220, a data signal can be generated and applied to the gate of each transistor T2 in the row, via the respective data line, in order to define which OLED pixel at this row could be activated. The data signal may be a binary signal having a 'HIGH' state and a 'LOW' state. It may further be a digital signal.

In step 230, the complete display matrix can be written by subsequent repeating of step 210 and 220 for every row. The gate of every T2 may get and store its own signal which is "HIGH" or "LOW".

During the addressing phase, when performing steps 210, 220 and 230, the main switch of FIG. 1(*b*) (107), can stay opened. The main switch 107 may be a part of the display control unit.

In step 240, the main switch 107 of FIG. 1(*b*) can be closed so that all the row connections and all the column connections may be switched to a power supply (voltage source). A current may flow through the activated AMOLED pixels emitting light.

Figure 3:
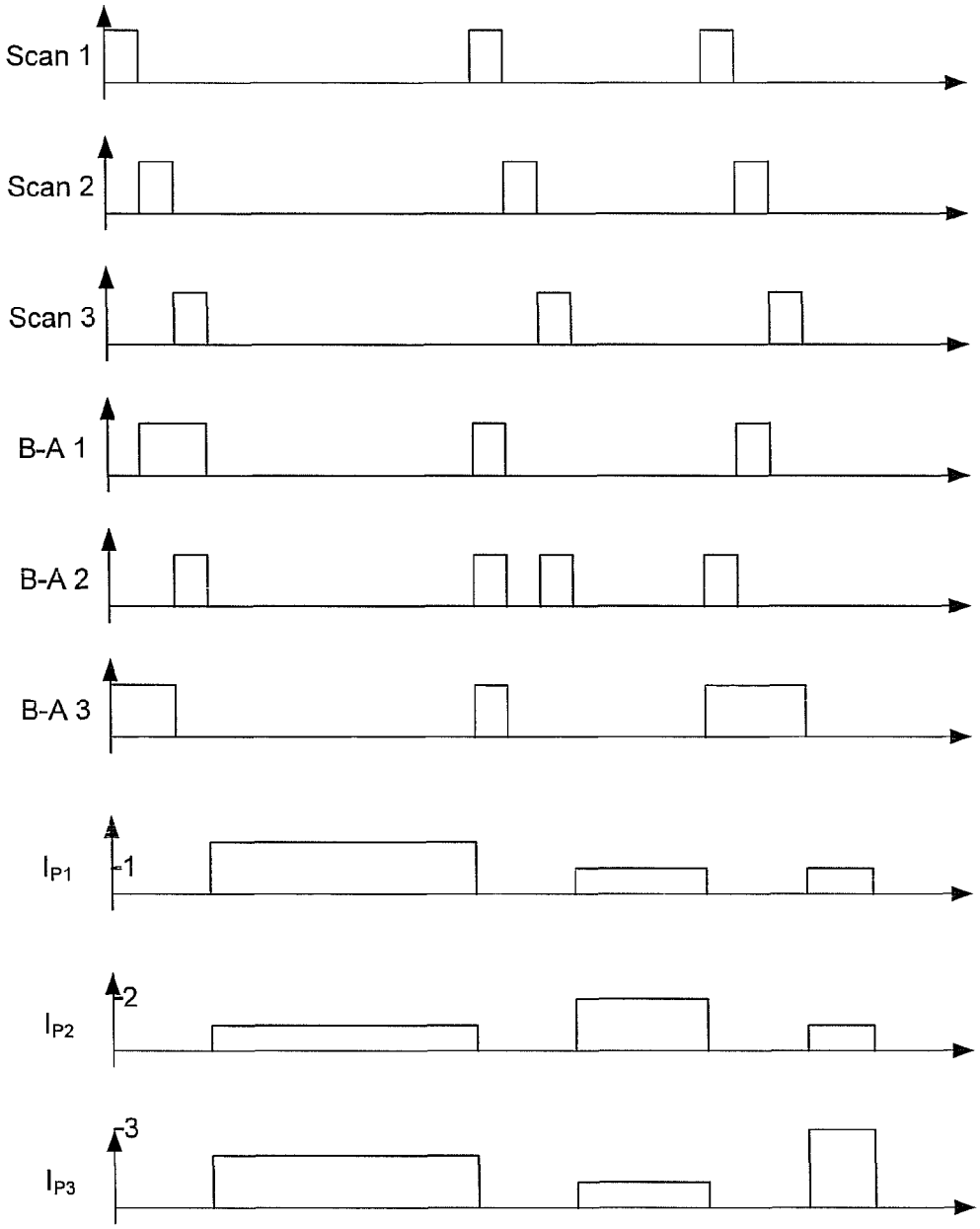
FIG. 3 shows an exemplary diagram of signals for addressing the active-matrix OLED-display shown in FIG. 1(*b*), is generated by the method shown in FIG. 2.

Exemplary FIG. 3 can show a timing diagram of signals for driving the AMOLED-display shown in FIG. 1(*b*), which can be generated by the method shown in FIG. 2. The main switch 107 in FIG. 1(*b*) can now be used for connecting or disconnecting the AMOLED pixels to the power supply (voltage source).

The 3×3 image to be displayed can have three bits per pixel to represent gray levels (0 to 7), as shown in the following table:

TABLE 1

| | | |
|---|---|---|
| 2 (=010) | 3 (=011) | 7 (=111) |
| 5 (=101) | 0 (=000) | 5 (=101) |
| 4 (=100) | 6 (=110) | 1 (=001) |

The x-axis shown in FIG. 3 represents time. In the beginning, the first row can be activated by the 'Scan 1' signal. In this phase, the most significant bits (MSB) of each luminance value/gray level for the first row can be applied to the data signal line (B-A1=Low, B-A2=LOW, B-A3=High) of each corresponding column and written into the active-matrix circuit.

Then, the second row may be selected (Scan 2). In this phase, the most significant bits of each luminance value for the second row can be written into the active-matrix circuit (B-A1=High, B-A2=Low, B-A3=High). The most significant bits for the third row may be written following the same scheme. After each of the most significant bits of all pixels have been written, this information may be converted to light by closing the main switch 107 and connecting all pixels to the voltage sources of the circuit shown in FIG. 1(*b*). The currents flowing into column lines 1, 2 and 3 are designated by $I_{P1}$, $I_{P2}$ and $I_{P3}$ in FIG. 3 (and depicted in FIG. 1(*b*)). The strength of the total current for a column j is proportional to the sum of the most significant bits for that column:

$$I_{Pj}=I_0\cdot(\mathrm{MSB}(1,j)+\mathrm{MSB}(2,j)+\mathrm{MSB}(3,j))$$

It can be assumed that all organic light emitting diode have the same characteristics. Since the anode-cathode voltage is the same, namely the voltage source in FIG. 1(*b*), the OLED current is therefore also the same. The OLED current $I_0$ can depend on the voltage of the voltage source. It may be roughly proportional to the set brightness of the display (e.g. 500 cd/m$^2$) and may be standardized to 1 for simplicity. For the luminance values of the above image/table, the following holds:

$$I_{P1}=0+1+1=2, I_{P2}=0+0+1=1, I_{P3}=1+1+0=2$$

The pulse width of the current applied to the diode is proportional to the positional value of the bit. For the most significant bit, it is equal to four (=$2^2$) time unit(s).

After the displaying of the most significant bit has taken place, the main switch 107 in FIG. 1(*b*) can be opened and the second bit may be written according to the same scheme as above. The rows may be selected sequentially via the respective scan line signal. The information for the second bits of that row may each be written to the data signal line of the respective column. Then, the currents may be applied to each column, their strengths again being proportional to the sum of the bits for that column. However, the pulse width is now half as long as in the case of the most significant bit, as the positional value of the second most significant bit corresponds to two (=$2^1$) time units. After that, all information for the second most significant bits of the gray values of the image, as shown in the above table, have been transformed into light.

In the above example, the third bit can be at the same time the least significant bit (LSB). The rows are selected and the individual pixels activated as just described. Only the pulse width may be one time unit now, corresponding to the positional value of the least significant bit, which is one (=$2^0$). Additionally, the whole image may have been completely displayed. It can include, for this exemplary embodiment, three subframes. The total duration of time for addressing and applying power of all subframes can correspond to the frame period.

In this exemplary embodiment, the OLED current is not flowing continuously, even for maximum gray value (7=111 in the above example). The maximum duration of current within a frame can be equal to the frame period minus the time for addressing. The number of addressing steps can be equal to the number of rows multiplied with the number of subframes (3×3=9 in the above example).

As the OLED lifetime and efficiency can depend on the amplitude of the current, the amplitude should be small. The perceived luminance of a pixel can correspond to the average value of the current over a frame period. In order to keep the amplitude of the current low, the row addressing time can be short.

If the gray value of a pixel is not the maximum, the current amplitude flowing through an OLED can remain as high as that of the maximum gray value. Since the duration of OLED conduction, which is proportional to the gray value, is shorter, the stress on the OLED may accordingly lower. Therefore, the OLED life time may not be negatively affected by this PWM-like control method.

The current from the voltage source Vs can be proportional to the brightness of the display and the total brightness of the image (sum of all pixel-values). It may be measured with-known methods, e.g. with a shunt resistor, with a current sense amplifier of the switch or with a current measurement function of the DC-DC transformer. It may be used to readjust the amplitude of the voltage Vs in case of a drift of the OLED diode voltage, for example due to changes in the temperature of the display during operation. Thus, the brightness of the display may be kept constant. The value of Vs may also be defined indirectly by the user, e.g. when he desires to change the brightness of the display.

The active-matrix circuit shown in FIG. 1(*b*) may be realized using two NMOS-transistors. Alternatively, two PMOS-transistors may be used analogously. It is emphasized that in this invention the driving transistors can also be driven as switches i.e. turned on or off. Therefore, the voltage value of Vs may be just a little higher than the forward voltage of an OLED diode.

In the above-described exemplary embodiment for addressing and driving a real active-matrix organic light-emitting diode display, the multitude of OLED-pixels in one column, or on the entire display respectively, may vary in their luminance. One cause for this is that the voltage that the organic light-emitting diodes in each column receive decreases due to resistances in the supply lines. This can hold true for the ITO-line (Indium Tin Oxide) that is placed in the front side of the display and possesses a significantly lower conductivity than the metal supply line placed in the rear side of the display. The upper diodes can receive more current than the lower diodes, even if the voltage just slightly decreases from an upper to a lower node. This may lead to a non-uniformity of the display, which is particularly relevant in the case of a large AMOLED display that is driven digitally.

For example, a white image, this can mean that every pixel may have the maximum gray value 255, which will be displayed by 8 subframes. The addressing signals for every pixel can be for every subframe are HIGH, while the duration of each subframe is different (e.g. 128, 64, . . . 2, 1). The so produced luminance distribution of a subframe, called as subimage in this specification, can be due to the trace resistance non-uniform. Each subimage can show the same non-uniformity. The total image displayed can be a superposition of the 8 subimages and also a non-uniform image, which may substantially differ from the objective, a white image.

Thus, in some exemplary embodiments, the non-uniformity of a digitally driven subframe can be compensated by further digitally driven subframes that the result finally equals the source image. According to some exemplary embodiments, the non-uniformity of a digitally driven subframe will be calculated/simulated based on physical characteristics of the AMOLED display. The decomposition into several subframes may consider the simulated non-uniformity of every subimage, so that the superposition of all subimages can yield for example to a white image, if the source image is white. So the digital driving method may utilize specific image data processing methods. It can include the simulation of the OLED pixel current distribution in dependence of a given binary subframe and a specific decomposition method to generate the proper subframes for addressing and driving.

According to a further exemplary embodiment, some above-described issues may be solved by suitable data/signal processing considering the physical characteristics of the display e.g. the resistance of the columns and/or of the rows, as will be described in the following. For example in one case, if column resistance is relatively high, while the ground resistance is negligible, it can be treated in the following description. In an opposite case, if the ground resistance is relatively high and the column resistance is negligible, it may be treated in a similar way.

Figure 4:
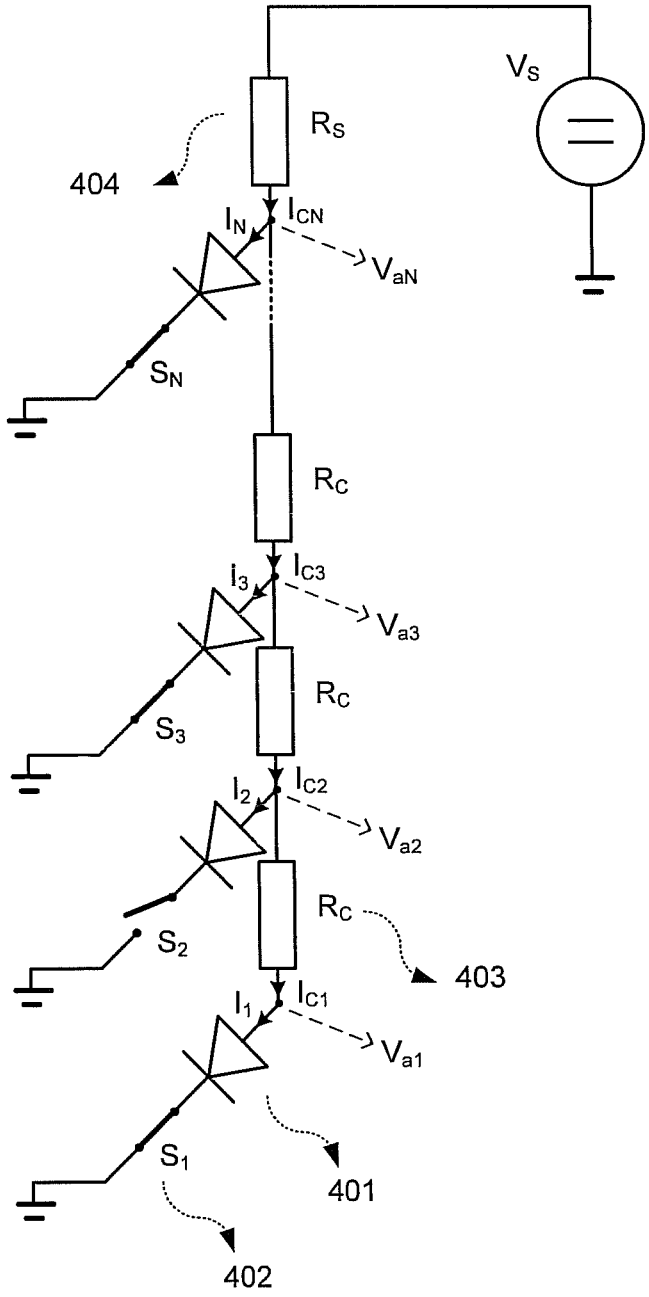
FIG. 4 shows an exemplary model of a column of AMOLED pixels, including resistances of the column not shown in FIG. 1(*b*).

Exemplary FIG. 4 shows a model of a column of AMOLED pixels, including resistances of the column not shown in FIG. 1(*b*). Since in this exemplary embodiment the driving transistors can be controlled as a switch, they are called pixel switch in the following and described as $S_i$. It is of binary nature and either 0 or 1 and describes whether the pixel switch is off or on. An AMOLED pixel can be modeled by an OLED (401) and a pixel switch (402). A purpose of the model in exemplary FIG. 4 can be to calculate the individual OLED current for each pixel in dependence of the states of the pixel switches and the column resistance Rc (403). For a static consideration, the OLED current may flow only in the driving phase, when the main switch 107 of FIG. 1(*b*) is closed. Thus, the main switch 107 is shortened and not shown in FIG. 4.

The individual column resistances (Rc) can have the same parameters as the individual pixels. In a real display, the column resistance and the diode parameters can gradually vary from a position to the adjacent position, so that the variation may be hardly perceivable. The resistance connected to the voltage source Rs (404) may have a different value. The anode of each organic light emitting diode is connected to an own node of the column line. Between the anodes of two adjacent diodes of a column, or between the two nodes, there can be a column resistance (Rc). The anode potential of the organic light emitting diodes varies because current flows through the column resistances (Rc), even if all cathodes have the same potential, e.g. ground. The distribution of voltage in a column according to FIG. 4 can depend on the states of the multitude of switches. Hence, the currents flowing through the many organic light emitting diodes could have different strengths, decreasing from top to bottom. That means that the switched-on OLEDs can have different luminance. So the simple digital drive method for an ideal display without column resistance, as described above, could lead to an undesired image being displayed. In order to produce a desired image by using the digital drive method, this exemplary embodiment can provide a method to simulate and consider the influence of the resistance of the power supply lines on the OLED current and thus luminance.

As one exemplary solution, the simulation method may be efficient, because the display matrix is huge and very complex and the simulation should be executed in real time.

The distribution of pixel currents in a column or for the entire display may be determined mathematically. However, classical methods e.g. known from the circuit simulation are so time-consuming, that the distribution of pixel currents may not be determined in the real-time, even if the simulation would be implemented in hardware. A circuit simulation could require the simultaneous variation of the potential of N nodes by iteration, until the desired precision is achieved. The computation time is roughly a square function of the complexity, in this case of N.

In the following description and equations, the voltages/potentials, the currents and the nodes are designated as in exemplary FIG. 4.

According to an exemplary embodiment, this complexity may be reduced by varying only parameter $V_{a1}$, the anode potential of the bottommost AMOLED pixel in the column shown in exemplary FIG. 4. The corresponding OLED current may then be determined using the model $$I_{OLED}=I_S\cdot[\exp(V_{AK}/V_T)-1]=I_{OLED}[V_{AK}]$$

In this model, the parameter $I_S$ represents the saturation current and $V_T$ the thermal voltage, which is for OLED typically between 0.5-1 V. The equation above may just be a rough representation of the current-voltage characteristics of an organic light-emitting diode. In a HW implementation, the current-voltage characteristics can be stored in a look up table (LUT) due to the HW efficiency, even if the equation above is a perfect fit.

As this function may be realized by a lookup table, when implemented in hardware, further effects such as the serial resistance of the diode and the on-resistance of the pixel switch etc. may be accounted for a direct implementation in the look up table $I_{OLED}[V_{AK}]$. The variable $V_{AK}$ is the potential difference between the node on the column line and the node on the ground line and effectively the anode-cathode voltage of the organic light emitting diode. The cathode potential and/or the resistance of the ground line can be considered later in this embodiment.

The function given above can describe the relation between the voltage at the organic light emitting diode and the OLED current. In other words, if the voltage at the OLED is known, the OLED current may also be known and therefore, the luminance of this OLED pixel. The absolute brightness of the display may be met by adjusting the voltage of the voltage source $V_S$ and the duration, how long the voltage source is applied to the AMOLED pixels. The gray value of a pixel describes its relative luminance. The corresponding gray value may be determined from the standardized OLED current.

More particularly, the determination of the pixel current distribution for a column may start with the lowest node. The column current at this position may be equivalent to the current of the bottommost AMOLED pixel. There, the potential is the lowest.

First, Va1 can be set to an initial value. This Va1 is the only variable for this column. The initial value may be taken from experience, like 4.5 Volt for example, if the supply voltage Vs is about equal to 5 Volts. The value may also be set depending on the states of the pixel switches for this column.

The potential for Va2 may be determined, in one exemplary embodiment, according to Kirchhoffs laws. S1 is the state of transistor T2 of the bottommost AMOLED pixel in FIG. 4. The pixel current $I_1$ corresponds to the current of this OLED and correlates to the light emitted by this OLED.

$$I_1=S_1 \cdot I_{OLED}[V_{a1}]$$

$$I_{C1}=I_1$$

$$V_{a2}=V_{a1}+I_{C1} \cdot R_C$$

$I_{OLED}[V]$ is the lookup table. Ic1 is the column current at the node 1. The column current to the second node Ic2 may be determined using Va2, subsequently Ic3 and Va3, as shown in FIG. 4.

$$I_2=S_2 \cdot I_{OLED}(V_{a2})$$

$$I_{C2}=I_{C1}+I_2$$

$$V_{a3}=V_{a2}+I_{C2} \cdot R_C$$

All node potentials from 1 to N may be determined accordingly. The supply voltage may be determined from VaN, the potential of top node n. In order to distinguish the calculated value from the real value (Vs), the calculated supply voltage will be designated Vc:

$$V_C=V_{an}+I_{CN} \cdot R_S$$

Rs is the resistance between the top node N and the voltage source Vs. Evidently, the calculated potential Vc and the supply voltage Vs differ. The difference may be reduced in a further iteration step. Va1 may be updated as follows:

$$\Delta V_{a1}=k \cdot (V_S-V_C)$$

$$V_{a1}(\text{new})=V_{a1}(\text{old})+\Delta V_{a1}$$

The parameter k is a correction factor, normally between 0 and 1. With a suitable choice of k, the difference between the calculated potential Vc and the predetermined supply voltage decreases rapidly. If the values differ only in the range of millivolts, the result can be precise enough for the difference not to be perceived by the human eye.

Limiting the number of iterations is important for achieving real-time execution. For fewer iterations the update of the variable Va1 may be realized by a non-linear function of (Vs−Vc) which may be stored in an extra LUT.

After the last iteration, the current ($I_1, I_2, \ldots, I_N$) and thus luminance of each pixel is determined in dependence on the pixel switches and the display parameters, in this case I-V characteristics of the AMOLED pixel and the column resistance.

Figure 5:
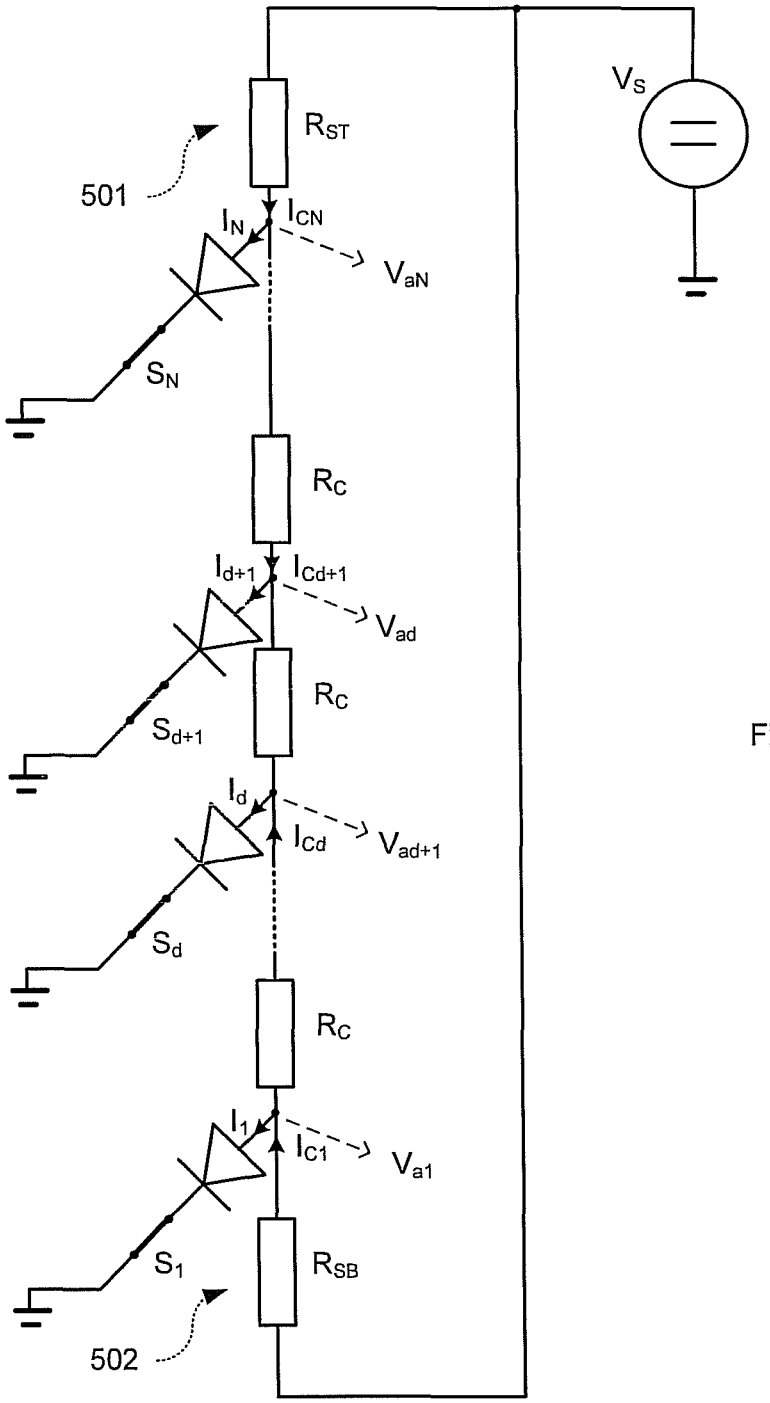
FIG. 5 shows an exemplary model of a column of AMOLED pixels as in FIG. 5, wherein both ends of the column line are connected to the voltage source.

For many reasons including a desired lower power consumption in some exemplary embodiments, the voltage drop in the column line should be as low as possible. An effective method is to connect both ends of the column to the voltage source. Exemplary FIG. 5 shows such a model of a column of AMOLED pixels, wherein both ends of the column are connected to the voltage source Vs and everything else stays unchanged. Beside the connection at the top side (501), the bottom side can also be connected to voltage source Vs with $R_{SB}$ (502). $R_{SB}$ were infinite in exemplary FIG. 4.

In the following description and equations, the voltages/potentials, the currents and the nodes are designated as in exemplary FIG. 5. Accordingly, node 1 may not only carry the pixel current I1. In order to simulate this embodiment of a display according to the invention, a further variable may be introduced, namely the position/node (d) in the middle of the column, where the direction of electrical current is reversed. The OLED currents from 1 to d all flow from bottom to top, while the OLED currents from d+1 to n all flow from top to bottom, similar to a water divide. It is called as current divide in this description.

Initially, a value for d may be assumed, e.g. half of the number of lines or depending on the [states of the] pixel switches in this column.

The potential between d and d+1 can be the lowest. As a first approximation, both potentials may be identical and used to set variable Vad. The individual OLED currents and the anode voltages may be determined using the method for the columns connected on one side described above. However, two voltages are obtained, designated as Vc1 and Vcn, which may then be used for the next iteration. Their average may be used for adapting the parameter Vad, while their difference may be used for adapting the position d:

$$\Delta V_{ad}=f(V_{C1}+V_{CN})$$

$$\Delta d=g(V_{C1}-V_{CN})$$

The number d may be a natural number. The distribution of potentials and pixel currents for the column may be obtained after a few iterations.

The simplification of assigning the same potential to nodes d and d+1 is normally unproblematic for high resolution displays. If higher accuracy is desired, two variables instead of one variable may be introduced, e.g. Vad and Vad+1. Then, Vad may be updated using Vc1 and Vad+1 may be updated using Vcn. The variable d may be updated using the difference between Vc1 and Vcn.

$$\Delta V_{ad}=f1(V_{C1})$$

$$\Delta V_{ad+1}=f2(V_{CN})$$

$$\Delta d=g(V_{C1}-V_{CN})$$

The potential difference between Vad and Vad+1 must be accounted for in the balance of electrical currents for nodes d and d+1. Alternatively, a third variable ddI may be introduced for the current between nodes d and d+1.

The variable ddI may be set to zero in the first iteration. After that, the variable d may barely change. The variable ddI may then be varied in order to increase the precision of the result.

Currents may also be used as variables instead of potentials. On this basis, other parameters, such as potentials, OLED pixel currents and other column currents may then directly be determined. For example, Icn may be chosen as a variable in FIG. 4:

$$V_{an}=V_S-I_{CN}\cdot R_S$$

$$I_N=S_N\cdot I_{OLED}[V_{an}]$$

$$I_{C,N-1}=I_{CN}-I_N$$

The starting node may be N, followed by successive processing from N, N−1, etc until 1. If the other end of the column is unconnected, Ic1 must be equal to the I1. Or an additional value Ic0 may be used:

$$I_{C0}=I_{C1}-I_1$$

Icn may be updated based on the difference between Ic0 and zero, such that the difference is decreased in the next iteration. The distribution of pixel currents may be obtained after a predetermined number of iterations.

If the other end of the column is also connected to the voltage source, as shown in FIG. 5, Vc1 (the calculated voltage at the very bottom) can be Vs. Icn may be updated based on the difference between Vc1 and Vs, such that the difference is decreased in the next iteration.

Two current variables may also be used to simulate a column connected at both ends. They may be the current at both ends Ic1 and Icn. The potential and the current at inner nodes may subsequently be calculated. In the center of the column, both opposite processing directions may meet each other. If the variables were perfect, both calculated currents and voltages could be identical. In reality this may not normally be true, especially for the first iteration. So the discrepancy of these two values (current and voltage in the center) may be used to update the two variables for the next iteration. The following equation may be a simple method to update the two current variables.

$$\Delta I_{C1}=h(\Delta I_{Center})+p(\Delta V_{Center})$$

$$\Delta I_{CN}=h((\Delta I_{Center})-p(\Delta V_{Center})$$

ΔIcenter and ΔVcenter are the current and voltage difference in the center of the column. The advantage of such an approach is that the processing time is halved, because the calculation is performed in two parallel paths.

In summary, this exemplary embodiment can show how the pixel current distribution may be determined using a small number of variables only. For a column connected on one end, only one variable is needed. For a column connected on both sides, only one to three variables may be sufficient. The basic models are the Kirchhoff's laws and device models, as an analog circuit simulation employs. Only simple mathematic operations like addition and multiplication are needed, so that the HW complexity/cost may be low and the processing speed may be high.

In the above example, it was assumed that all cathodes are connected to ground and therefore, have ground potential. This is an approximation, as the ground connections are often made of relatively thick metal and possess therefore a significantly lower resistance than the column lines. But even this approximation may lead to visible errors, for example if the brightness of the display, i.e. the OLED currents are high. Hence, the resistance of the connection at the cathode side of AMOLED pixels may also need to be considered. In some exemplary embodiments of AMOLED displays, this connection is physically a metal plate, i.e. it may not have structure like lines. In order to simplify the simulation/calculation for the case, that the voltage drop in the metal plate were no more negligible (e.g. in the range of about 10 millivolts), the connections may be structured as parallel lines, one for each row. Such a structure may decouple the row variables used for the processing. This means that each row variable will be updated just in dependence of the differences between real and calculated values at one row. Such a row line is called as ground line in the invention.

The utilization of such a physical structure is also valid for the column. This means that for one column one separated line may be used, so that for the update of each column variable just the difference between real and calculated values at one column, as described above, may suffice.

Figure 6:
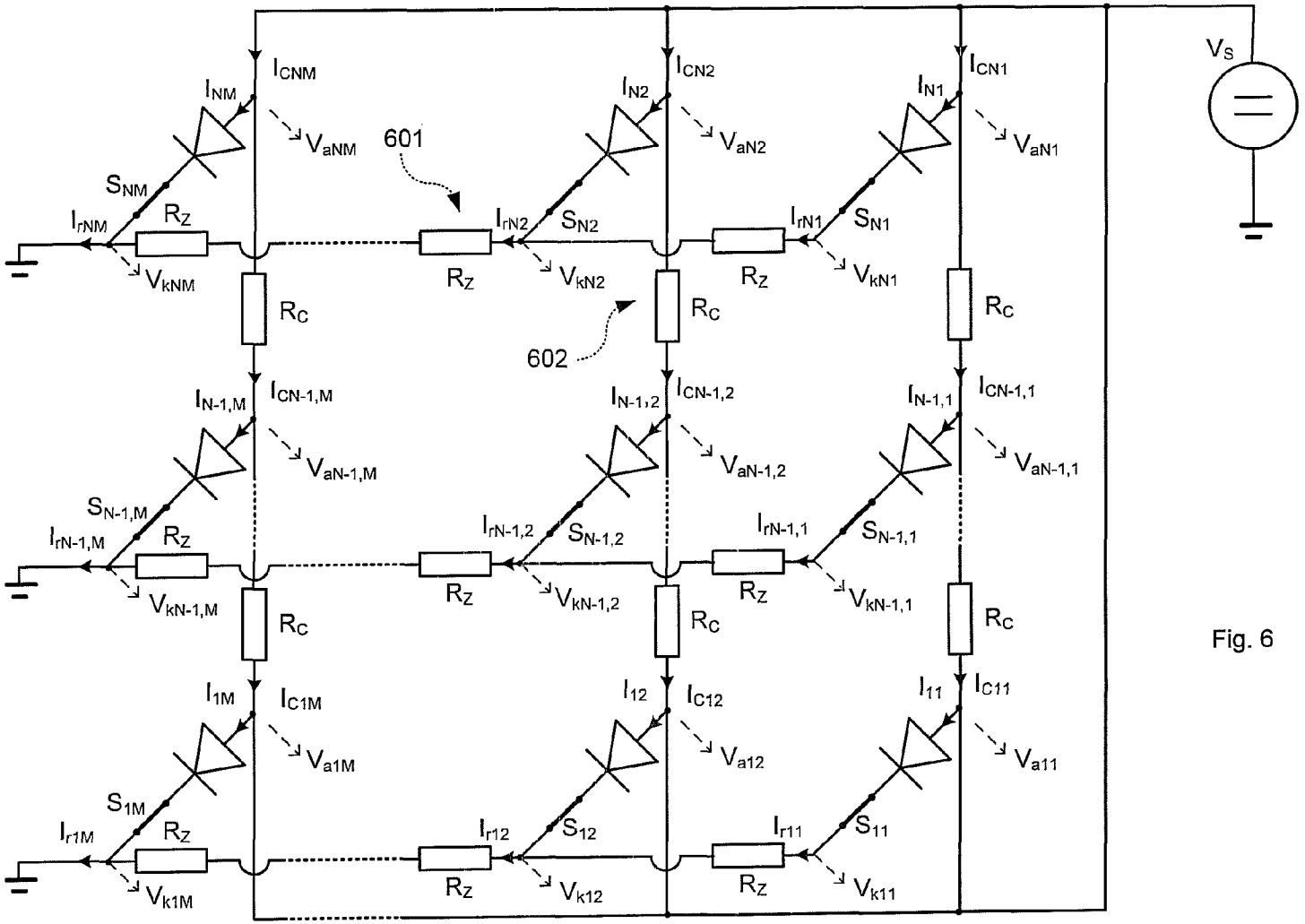
FIG. 6 shows an exemplary model of a matrix circuit with row and column resistances, wherein all columns and all rows of the matrix circuit are connected to both poles of the voltage source respectively.

Exemplary FIG. 6 shows a model of a matrix circuit with row and column resistances, wherein all columns and all row of the matrix may be connected to the same voltage source.

The cathode of each AMOLED pixel may no longer be connected to the ideal ground, but to an individual node. Two adjacent nodes of a row are connected to each other via the row resistance Rz (601). The column resistance is Rc (602), as in exemplary FIGS. 4 and 5. All row connections can be on the left hand side. For the sake of simplicity, the resistances of the connections for rows and columns can be omitted. How they may be taken into account has already been described in connection with exemplary FIG. 4.

In the following description and equations, the voltages/potentials, the currents and the nodes are designated as in exemplary FIG. 6.

Now, a variable may be introduced for each cathode in the right-most column of each row. The variable can represent the cathode potential of the right column Vki1, wherein i represents the row number. The rightmost column is column number 1, the leftmost column is designated with M. Hence, the display has a resolution of M×N pixels. The determination can be the same as the one for the individual rows, but the OLED current does not only depend on the anode potential but also on the voltage between anode and cathode, i.e. the difference between the anode potential and the cathode potential:

$$I_{ij}=S_{ij}\cdot I_{OLED}(V_{aij}-V_{kij})$$

The current-voltage function remains the same and is preferably stored in a lookup table. Therefore, only the input changes, as $V_{kij}$ is not equal to zero anymore.

The method for column 1 can be similar to the one for single column connected on both sides, where the row resistance was neglected. It was described in connection with exemplary FIG. 5. One to three variables may be used. The simplest exemplary way is to estimate one current value for each column $I_{cNj,j}$ being the column number. For the row a current or a voltage variable may be chosen. In the equation below, $V_{kN1} \ldots V_{k11}$ are chosen as the variables for rows. The row current $I_{rij}$ accumulates the pixel currents from right to left (1 . . . M) flowing into that row.

For the first column:

$$V_{aN1}=V_S$$

$$I_{N1}=S_{N1}\cdot I_{OLED}[V_{aN1}-V_{kN1}]$$

$$I_{cN-1,1}=I_{cN1}-I_{N1}$$

$$I_{rN1}=I_{N1}$$

$$V_{kN2}=V_{kN1}-R_Z\cdot I_{rN1}$$

$$V_{aN-1,1}=V_{aN1}-R_C\cdot Ic_{N-1,1}$$

This procedure may propagate to further rows and columns. On this base, all OLED currents and node potentials of the display matrix may be determined. The potential of all ends of the columns (bottommost position) should be Vs and the potential of all connected ends of the rows (leftmost position) should be zero. Naturally, difference between the calculated and real potentials may still exist. These differences may be reduced by further iterations, so that after a predetermined number of iterations the simulation is sufficiently accurate for human perception.

In the first iteration, the values for Vki1 may be assumed, i being the row number, i.e. all cathode potentials for the first column. The same is true for the node currents of the top row, as described above. The initial values for the variables may be set based on experience or based on a rough estimation of the binary subframe data, e.g. of the corresponding row/column.

Current and voltage may also be assigned as variables for each row and/or column in a mixed fashion. In the equation system above, currents for columns and voltages for rows are chosen as variables. Also currents for columns and currents for rows (e.g. for the case of exemplary FIG. 6, the row currents at the leftmost position) may be chosen. For updating the row current variables, the current balance at the rightmost position of rows is the objective.

Voltage and current variables may even be mixed for rows and/or columns alone. For example, for an interlaced connection of rows, the voltage variables may be assigned to odd rows and current variables may be assigned for even rows. It may be advantageous that the subsequent processing is in just one direction, e.g. all rows leftwards.

Therefore, a distribution of pixel currents may be determined for all rows and columns of a matrix display using only a few variables. The number of variables can be no more M*N, but M+N. These variables are updated independently. Thus, the simulation method of this invention drastically reduces the computation effort needed. It makes the real-time simulation possible.

A large AMOLED display is usually a color display and is often realized using RGB columns. This requires three IOLED(Vak) lookup tables for the corresponding OLED characteristics. During processing, the corresponding lookup tables may then be used for the different columns.

The current-voltage characteristics of an AMOLED pixel stored in a LUT is usually static. The OLED current may be correlated to the luminance. Beside the strength of the current, the luminance is also a function of the duration, how long the OLED of the AMOLED pixel is activated. The duration may be controlled by the main switch in exemplary FIG. 1(*b*). It is known, however, that high temporal accuracy/resolution may be realized at low HW cost.

Figure 7:
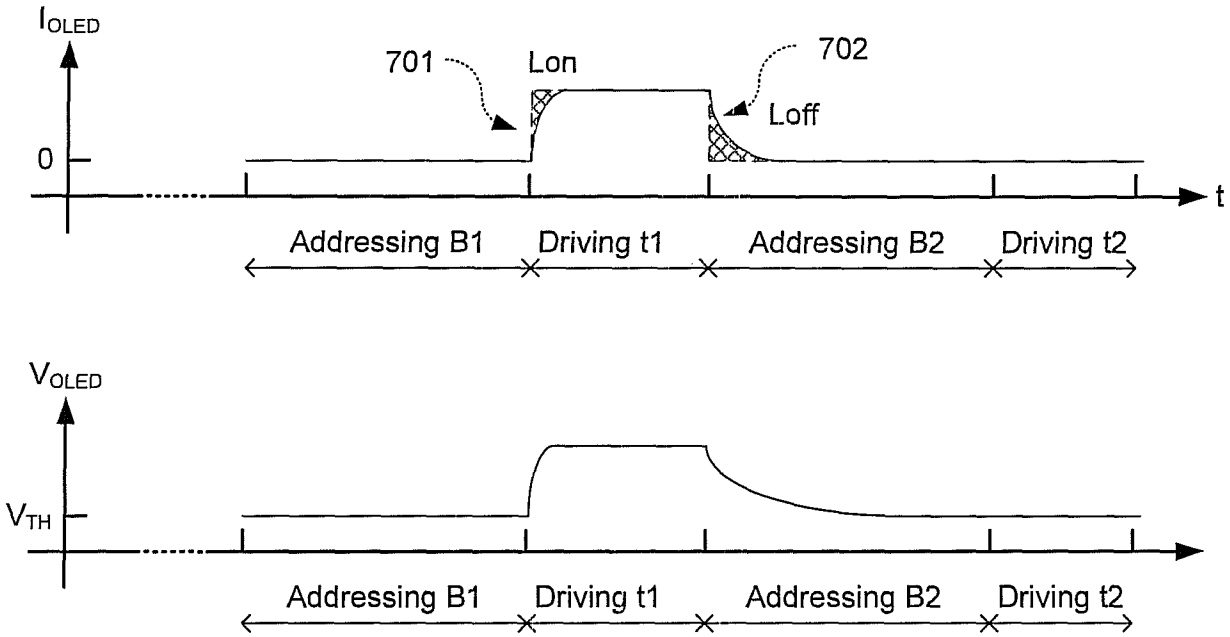
FIG. 7 shows exemplary current and voltage waveforms of an AMOLED pixel.

However, an OLED current at turn on and turn off phase may not exactly follow the control pulse of the main switch, as exemplary FIG. 7 illustrates. For every subframe, the complete display matrix has been addressed e.g. row by row. During addressing the main switch (FIG. 1(*b*)) is open. After the addressing, the main switch is closed, so that an OLED current may flow, provided that this AMOLED pixel is activated before (pixel switch on). This is the case for the first subframe in exemplary FIG. 7, while the AMOLED pixel is passive in the second subframe. How the binary subframe values are generated can be described in more detail below.

Figure 8:
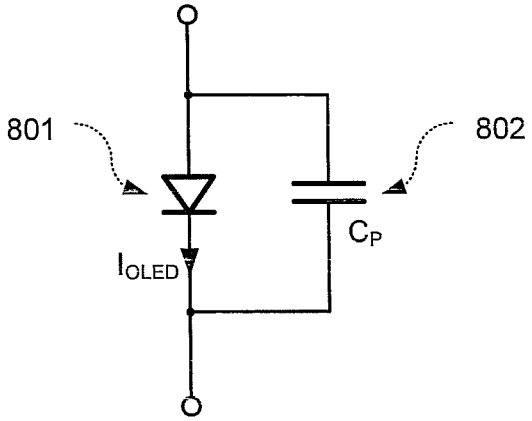
FIG. 8 shows an exemplary electrical equivalent circuit for an organic light emitting diode with internal capacitance.

The current waveform may show a substantial deviation to the ideal rectangle control pulse for the main switch which is "HIGH" during the driving phases. The deviation can be due to the internal capacitance of OLED (802) as modeled in exemplary FIG. 8. The current through the diode in this model (801) produces light and is called as OLED current (Ioled) in this exemplary embodiment. The light perceived by a viewer is proportional to the average value of the OLED current for a frame period.

At switching on of the main switch for t1, the OLED current can be lower than the stationary value (exemplary FIG. 7). At turn off, the OLED current is still flowing, because the internal capacity Cp can be discharged by the diode emitting light according to the model (exemplary FIG. 8). As the addressing time for the next subframe may be relatively long due to the high number of rows, the diode can be discharged till the threshold voltage of OLED (Vth). So the light produced after turn off is proportional to the integrated diode current in this phase which is equal to the change of the charge stored in Cp:

$$Loff\propto Cp\cdot(Vak-Vth)$$

Vak is calculated anode-cathode voltage according to the method described above, so that this luminance contribution Loff, the second hatched area (702) in exemplary FIG. 7, may be determined. For turn on there can be a small deficit, because the OLED current needs a little time to reach the stationary value. The deficit Lon is the first hatched area (701) in FIG. 7 and may roughly be described as constant for a given display brightness. The sum of both luminance components (Ldyn) may be described as:

$$Ldyn=-Lon+Loff\propto Cp\cdot Vak-(Lon+Cp\cdot Vth)=Cp\cdot Vak-Los$$

Los is an offset term and may be set as constant for a certain operation condition. Beside OLED parameters (Cp, Vth), it may consider the influence of the set brightness of the display and/or the temperature. For the sake of simplicity, even Ldyn may be approximated as constant. The total luminance of an activated AMOLED pixel can be:

$$Lij\propto D\cdot Iij+Ldyn$$

D is the width of the pulse. The deviation for a long pulse due to dynamic switching effects may be small, because D is long. For a short pulse Ldyn may need to be considered to get the luminance calculated more accurately.

According to the description above, this exemplary embodiment utilizes an efficient method that can simulate the pixel current/luminance distribution at a given binary matrix stating which pixel switches are on or off.

In the following exemplary embodiment, it may be described how a binary subframe can be determined at a given gray value matrix which is normally used as the image data.

The pixel current distribution, flowing at a digital driving as well as simulated by the method described above, is designated by the simu($B_i$) function in this specification.

The physical production of luminance distribution of a digitally driven subframe can be called as subimage in this embodiment. In difference to the binary subframe, it can be described by gray-values of several bits.

A source image I, described as a matrix of pixels normally having 8 bit gray levels, may be composed as a sum of subimages:

$$I = L_1 + L_2 + \ldots + L_f = \sum_{i=1}^{f} L_i$$

A subimage may be described by the following equation:

$$L_i = t_i \cdot \mathrm{simu}(B_i)$$

The magnitudes of $t_i$ can depend on the display parameters and the brightness of the display. The same can hold for the number of subframes f. For a real display exhibiting supply line resistances, internal capacitances etc., more than 8 subframes may be desired for 8 bit gray-scale. $t_i$'s and the number f may be predetermined for each display model individually. In order to achieve a desired degree of accuracy, the precision of $t_i$ may be higher than 8 bits, e.g. 12 bits.

Each subimage $L_i$ may be a simulated luminance distribution in dependence of the binary subframe $B_i$ and the time factor $t_i$. The subframes $B_i$ can be matrices with binary elements for controlling whether the pixels are switched on or off. The time factor for a particular subframe $B_i$ is designated by $t_i$ and correlated to the on duration of the main switch (107) in exemplary FIG. 1(*b*). simu($B_i$) is the pixel current distribution in dependence of the subframe $B_i$, as simulated according to the method described above. The subimage can be a simulation result and may approximate the real physical luminance distribution produced by the AMOLED display.

If the column and row resistance are zero, simu($B_i$) can be identical to the subframe matrix $B_i$ and $t_i$ are 128, 64, . . . , 2, 1 for the 8 bit gray scales. This is named as an ideal case described at the beginning of this specification which does not need a specific data processing.

For a real display exhibiting supply line resistances, internal capacitances etc., each element of the simu($b_i$) matrix may no longer be a binary number, but can be of several bits resolution to consider the non-uniform distributed pixel current of the display. It may be standardized between zero and unit. A reasonable standardization factor may be the possible maximum current. For example, for exemplary FIG. 6 the maximum current $I_{MAX}$ can be:

$$I_{MAX} = I_{OLED}[V_S]$$

which is $I_{NM}$, if this pixel is active ($S_{NM}$=1). A lookup table may be used for the standardization to consider nonlinear correlation between pixel current and pixel luminance.

So the source image may be described as:

$$I = t_1 \cdot simu(B_1) + t_2 \cdot simu(B_2) + \ldots + t_f \cdot simu(B_f) = \sum_{i=1}^{f} t_i \cdot simu(B_i)$$

Based on the simu($B_i$) function, the image matrix I may be successively decomposed by subimages. The binary matrices $B_i$ may be subsequently determined as described below.

Figure 9:
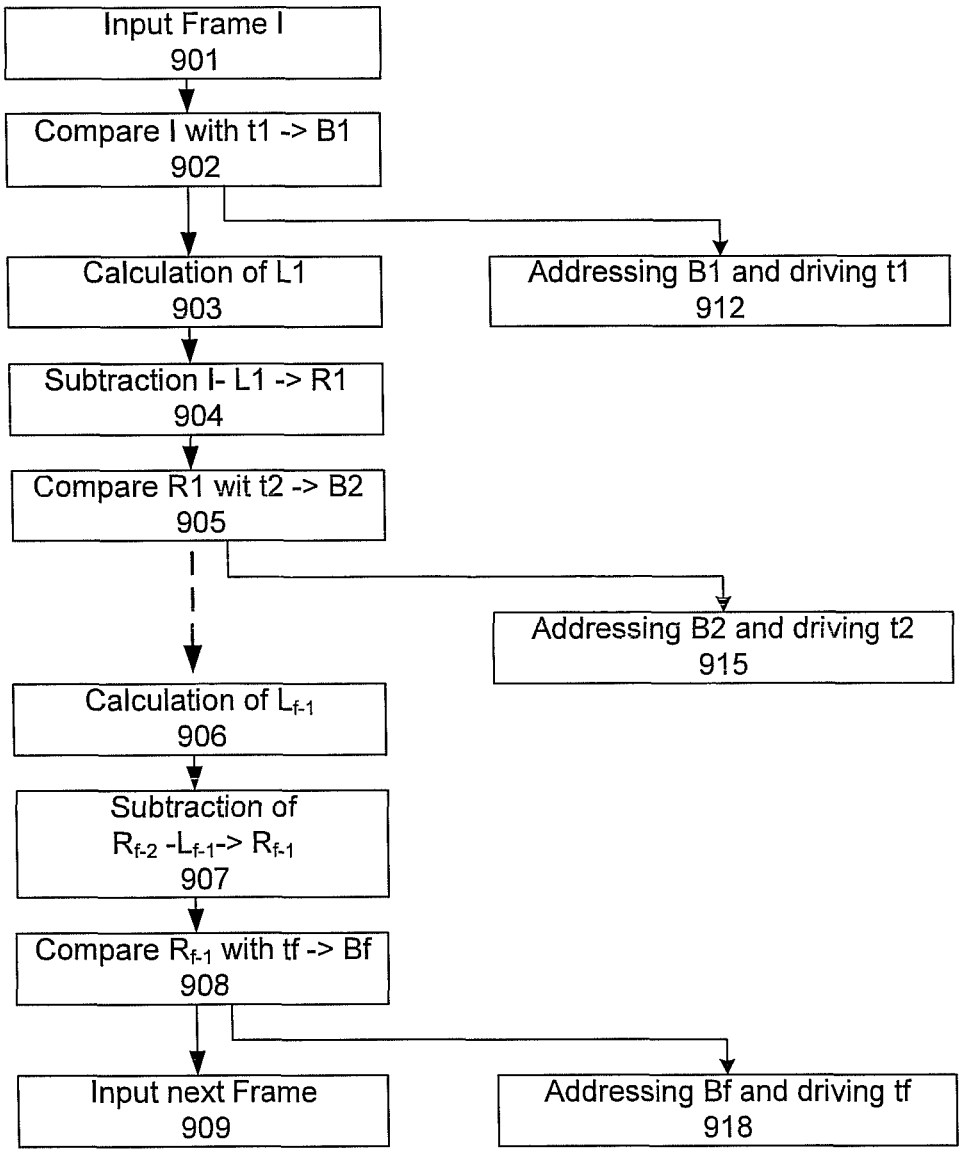
FIG. 9 shows an exemplary flowchart of a method for generating a sequence of binary-value images used for driving an AMOLED display from a gray-value or a color value image.

Exemplary FIG. 9 may show a flowchart of a method for generating a sequence of binary-value subframes used for driving an AMOLED display from a gray-value or a color value image (input frame).

In step 901, the frame I may be inputted and stored.

In step 902, the matrix designated as $B_1$ for the brightest subframe can be determined, whose time factor t1 is the highest. The method may just be a simple compare function. $t_1$ can be used as the threshold value. If the gray value of pixel ij is greater than $t_1$, then $B1_{ij}$=1. Otherwise, $B1_{ij}$=0. The determination of may follow the image data pixel-wise. That way, the first subframe B1 may be obtained.

In step 912, the B1 information may be immediately used to address the display pixels. After addressing, the main switch may be turned on for a duration correlated to t1, so that the AMOLED display may produce the first subimage. The duration for a subframe may consider the influence of the internal capacitance of the OLED and may be realized by high temporal accuracy/resolution.

In step 903, the simulation method described in this invention, which may be implemented on a specific chip, an FPGA (field programmable gate array), a processor device or a computer, may be executed. Using the information of B1, the actual luminance distribution of the displayed subframe (subimage $L_1$) may be simulated by varying a few parameters for each row and column and by obtaining a precise result after a few iterations. The calculation may be executed concurrently to the relatively long addressing time of the complete display and the following driving time for $B_1$ and $t_1$ respectively (step 912). While the addressing time for a subframe can be constant, the driving phase may be different for each subframe. The first subframe can have the longest driving time and may be also the brightest subimage. The higher $t_i$ the brighter the subimage $L_i$. The driving time may also be used for the calculation, so that more iterations are possible. This may lead to a higher accuracy of the simulation which may be of higher importance for brighter subimages.

The OLED currents may be standardized to discrete gray level values, which may also be implemented by the lookup-table $I_{OLED}$[Vak]. The first subimage thus obtained, designated by L1, is proportional and/or correlated to each OLED current $I_{ij}$ and the time factor $t_1$ of this subframe.

In step 904, the first remaining image to be displayed, $R_1$, can be calculated. It may be derived by the following simple subtraction:

$$R_1 = I - L_1$$

The source image I may be considered as the initial or 0-th remaining image ($R_0$). The precision of $L_1$ as well as $R_1$ may be described with more than 8 bit, e.g. 12 bit to avoid/limit truncation error of the simulation.

In step 905, every gray level value of $R_1$ may be compared to $t_2$ in order to obtain the binary matrix B2. $t_2$ is the second highest time factor.

In step 915, B2 can be used for addressing and driving the AMOLED displays.

Such a procedure may be subsequently executed to get $B_i$ values for addressing and driving. At the same time, the corresponding subimage can be simulated and the next remaining image may be calculated. For example, the second subimage $L_2$ can be simulated, then the second remaining image $R_2$ can be calculated:

$$R_2 = R_1 - L_2$$

The binary matrices may successively be determined starting from the highest time factor ($t_1$) to the lowest, as well as the obtained subimages $L_i$.

In step 906, the second last subimage $L_{f-1}$ can be simulated or calculated, as desired.

In step 907, the second last remaining image $R_{f-1}$ can be calculated.

In step 908, the last binary subframe $B_f$ can be generated, once again by a compare function, as desired.

In step 918, the last subframe $B_f$ can be addressed and driven.

No simulation of the last subimage may be necessary, as no further subframe may be needed. After the last (f-th) subframe, the missing luminance or luminance overshoot at each pixel may be less than one least significant bit (LSB) or less than half LSB gray value. Hence, the desired image may be exactly reproduced by the active-matrix OLED display according to the invention.

In step 909 and the following steps, the next frame (image data) may be inputted, processed and driven according to the method starting from 901.

According to the description above, this exemplary embodiment can utilize a method to decompose a gray value image onto a set binary subframes for addressing an AMOLED display.

Since OLED currents may flow through the main switch (107) (exemplary FIG. 1(*b*)) and may produce a voltage drop at the main switch (107), it may be worth to measure and/or to estimate this voltage drop and thus correct the real value for Vs in the simulation. The information of the subframe, e.g. the number and the positions of active pixels, may be used for the estimation. This may assure a closer correlation between the simulation and reality.

Some exemplary embodiments described herein can be based on physical characteristics of the device. The physical parameters may vary with the temperature. To be mentioned are OLED current-voltage characteristics and resistance of column and row. It may be desired to measure the temperature or temperatures of the AMOLED display during the operation and adjust the device parameters like the LUTs for OLED current-voltage characteristics, etc. Also the predetermined values for t1, t2 etc. may depend on temperature or temperatures. Since the temperature or temperatures can change relatively slowly, the adjustment of the parameters may be not time-critical. Such a measure may allow a wider range of operation temperature or temperatures.

Figure 10:
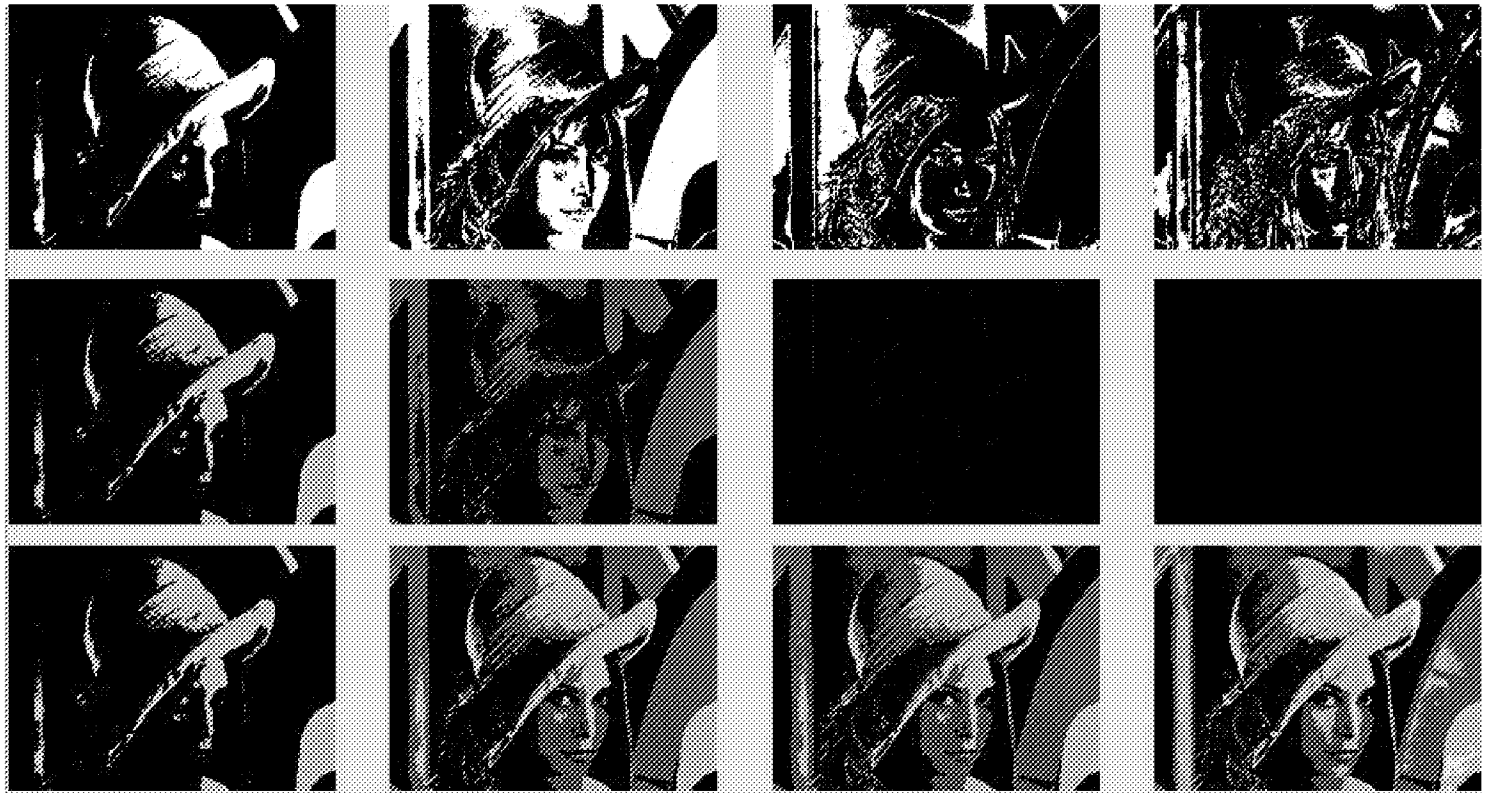
FIG. 10 shows exemplary images utilizing the methods described herein.

Exemplary FIG. 10 provides an example of decomposition. In this example, the display can have a QVGA resolution (320 column 240 row). The two ends of the column may be connected to power supply and the left side of rows can be connected to ground. Then, in this example, the first row 1002 can be a plurality of binary subframes which may be used for addressing. The second row 1004 can be a plurality of gray subimages (Li) which may be. simulated. The third row 1006 can be a plurality of accumulated subimages (L1+ L2* . . . +Li) and successively produce a desired result.

Thus, exemplary embodiments described herein can allow for a simple active matrix manufacturing process and high yield, as the transistors can be operated just as switches. In addition, the power consumption of such a digital drive scheme can be much lower than the analog drive scheme.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed:

1. A method for driving an active matrix organic light-emitting diode (AMOLED) display having organic light-emitting diodes (OLED) arranged in rows and columns, a pixel circuit for driving an OLED, a scan line for selecting the pixel circuits of each row and a data line for controlling the pixel circuits of each column and supply lines connectable to the anodes and cathodes of the AMOLED pixels, comprising:

simulating pixel current distribution of an AMOLED display based on a dependence of at least one of an internal OLED capacitance and resistance of at least one or more of the supply lines, the columns and the rows of the AMOLED display;

decomposing image data into plurality of binary subframes;

generating binary subframe signals according to the decomposed subframes;

activating an organic light emitting diode, based on a scan signal on the scan line and a generated subframe signal applied on the data line, allowing or blocking a current to flow via the supply lines through the organic light emitting diode; and connecting the supply lines to a voltage source for a duration correlated to a predetermined threshold value (ti) for the binary subframe.

2. The method of claim 1, wherein the decomposition of the image depends on the set brightness of the display.

3. The method of claim 1, wherein a voltage value of the voltage source is a function of set brightness of the display.

4. The method of claim 1, further comprising detecting an OLED temperature or temperatures during the operation to adapt at least one of parameters of physical characteristics like current-voltage characteristics of OLEDs, values of trace resistances and a voltage value of the voltage source.

5. The method of claim 1, wherein the binary value subframe is generated by a comparison function with remaining image data as an input.

6. The method of claim 5, further comprising simulating a pixel-wise luminance distribution of the AMOLED for a given binary subframe to calculate a next remaining image data.

7. The method of claim 6, further comprising use of electro-optical characteristics of OLEDs and resistance of the supply lines during the simulation of a pixel-wise luminance distribution of the AMOLED display.

8. A method for the determination of a sequence of binary-value subframes used for addressing and driving an AMOLED display from a gray-value or a color value image, comprising the steps:

obtaining a binary value subframe from a remaining image by comparing the gray or color values with a predetermined threshold value;

simulating a pixel-wise luminance distribution of the AMOLED display, based on the binary subframe and the predetermined time factor;

subtracting the pixel-wise luminance distribution of the AMOLED display from the actual remaining image data in order to calculate a next remaining image data; and iterating the above steps with a next remaining image instead of the remaining image.

9. The method of claim 8, further comprising storing the remaining image data after each subframe.

10. The method of claim 9, further comprising dissolving of the remaining image data is higher than that of the source image.

11. The method of claim 8, wherein an own threshold value is used for each iteration.

12. The method of claim 8, wherein the thresholds are predetermined in dependence of physical characteristics of the AMOLED display and the set brightness.

13. The method of claim 8, wherein the predetermined threshold values are a function of the temperatures of the AMOLED display.

14. The method of claim 8, wherein generation of the subframe for a higher threshold value is prior to that for a lower threshold value.

15. The method of claim 1, wherein the duration for connecting the supply lines to the voltage source is correlated to a threshold value for obtaining the binary value subframe.

16. A method for simulating a pixel current distribution of an AMOLED display, wherein the display comprises a matrix of AMOLED pixels, arranged in rows and columns, wherein all AMOLED pixels are driven digitally, wherein all AMOLED pixels in a column are connected to a supply line for that column, wherein at least one end of the supply line is either connected or switched to a voltage source comprising, for a column of AMOLED pixels in the matrix, the steps of:

estimating a value for a voltage/current for a selected node of the column;

calculating at least one of a voltage value and a current value for remaining nodes of the column, based on one of an estimated voltage or current value;

iterating the previous steps in order to reduce a difference between a calculated voltage or current value and a real voltage or current value at a chosen location of the column; and simulating pixel current distribution of an AMOLED display.

17. The method according to claim 16, wherein the simulation of the pixel current distribution for a binary subframe is executed during at least one of the addressing and driving phase for this subframe.

18. The method according to claim 16, wherein the number of iterations is limited.

19. The method according to claim 16, wherein the number of iterations for each subframe (Bi) depends on a duration of the corresponding time factor (ti).

20. The method according to claim 16, wherein, for a subframe, the calculated pixel current distribution is correlated to a luminance distribution of this subframe.

21. The method according to claim 20, further comprising an internal OLED capacitance for a simulation of a pixel-wise luminance distribution of the AMOLED display.

22. The method according to claim 16, further comprising use of supply connections structured in parallel lines with one line for each column.

23. The method according to claim 16, wherein the selected node is at an end of the column.

24. The method of claim 16, further comprising choosing at least one of a node and a position of a current divide in the column.

25. The method according to claim 16, wherein the current-voltage characteristics of an OLED are stored as a lookup table.

26. The method according to claim 16, further comprising estimating a value for at least one of the voltage and current for a selected node of a row.

27. The method according to claim 16, further comprising considering the resistance of the row lines.

28. The method of claim 16, further wherein a pixel current that is at least one of an estimated or calculated current is applied for a calculation of an anode potential of the next pixel at a same column and for a calculation of a cathode potential of the next pixel at the same row.

29. A device for driving an active matrix organic light-emitting diode (AMOLED) display, the display comprising organic light-emitting diodes (OLED) arranged in rows and columns, a pixel circuit for driving an OLED, a scan line for selecting the pixel circuits of each row and a data line for controlling the pixel circuits of each column and supply lines connectable to the anodes and cathodes of the AMOLED pixels, comprising:

a circuit that simulates pixel current distribution of an AMOLED display based on a dependence of at least one of an internal OLED capacitance and resistance of at least one or more of the supply lines, the columns and the rows of the AMOLED display;

a circuit that decomposes the image data into a plurality of binary subframes;

a circuit that generates binary subframe signals according to the decomposed subframes;

a circuit that activates an organic light emitting diode, based on a scan signal on the scan line and a generated subframe signal applied on the data line, and that allows or blocks a current from flowing through the organic light emitting diode; and a circuit that connects the supply lines to a voltage source for a duration correlated to a predetermined threshold value (ti) for the binary subframe.

30. A device for the determination of a sequence of binary-value subframes used for addressing/driving an AMOLED display from one of a gray-value or a color value image, comprising:

a circuit that obtains a binary value subframe from one of a gray value or color value remaining image by comparing the gray or color values with a predetermined threshold value;

a circuit that simulates a pixel-wise luminance distribution of the AMOLED display, based on the binary value subframe and a predetermined time factor;

a circuit that subtracts the pixel-wise luminance distribution of the AMOLED display from the remaining image data in order to calculate the next remaining image data.

31. A device for simulating a pixel current distribution of an AMOLED display, wherein the display comprises a matrix of AMOLED pixels, arranged in rows and columns, wherein all AMOLED pixels are driven digitally, wherein all AMOLED pixels in a column are connected to a supply line for that column, wherein at least one end of the supply line is connected/switched to the voltage source, comprising, for at least one of a column or a row of AMOLED pixels in the matrix:

a circuit that estimates at least one of a voltage or a current for a selected node of the at least column or row;

a circuit that estimates the voltage/current values for the remaining nodes of the at least column or row, based on an estimated value of the voltage or the current;

a circuit that repeats the previous steps in order to reduce the difference between the calculated and the real voltage or current value at a chosen location of the at least column or row; and simulating pixel current distribution of an AMOLED display.

32. An active matrix organic light-emitting diode (AMOLED) display module comprising:

an active matrix organic light-emitting diodes AMOLED display, a device that simulates of a pixel current distribution of the AMOLED display based on a dependence of at least one of an internal OLED capacitance and resistance of at least one or more supply lines, columns of the AMOLED display, and rows of the AMOLED display, a device that decomposes image data into plurality of binary subframes, a device that determines a sequence of binary-value subframes used for addressing/driving the AMOLED display from one of a gray-value or a color value image, and a device that connects the supply lines of an AMOLED display to a voltage source for a duration correlated to a predetermined threshold value (ti) for the binary subframe, wherein at least one supply side of the AMOLED display, anode and/or cathode, is structured in parallel lines with one line for each column/row.

33. The method of claim 4, wherein the binary value subframe is generated by a comparison function with remaining image data as an input and further comprising simulating a pixel-wise luminance distribution of the AMOLED for a given binary subframe to calculate a next remaining image data.

* * * * *